US006641117B2

(12) United States Patent
Heun et al.

(10) Patent No.: US 6,641,117 B2
(45) Date of Patent: Nov. 4, 2003

(54) APPARATUS FOR ASCERTAINING A CABLE MOTION FOR A HOIST, IN PARTICULAR A PNEUMATICALLY OPERATED CABLE BALANCING HOIST

(75) Inventors: Jürgen Heun, Dortmund (DE); Markus Löbel, Witten (DE); Klaus-Jürgen Winter, Wetter (DE)

(73) Assignee: Demag Cranes & Components GmbH, Wetter (DE)

( * ) Notice: Subject to any disclaimer, the term of this patent is extended or adjusted under 35 U.S.C. 154(b) by 0 days.

(21) Appl. No.: 10/156,627

(22) Filed: May 28, 2002

(65) Prior Publication Data

US 2002/0175320 A1 Nov. 28, 2002

(30) Foreign Application Priority Data

May 28, 2001 (DE) ..... 101 27 238

(51) Int. Cl.[7] ..... B66D 1/30
(52) U.S. Cl. ..... 254/371; 254/374
(58) Field of Search ..... 254/371, 374, 254/278

(56) References Cited

U.S. PATENT DOCUMENTS 2,497,220 A * 2/1950 Humberson ..... 226/193
4,114,435 A * 9/1978 Patton et al. ..... 73/152.45
4,475,163 A * 10/1984 Chandler et al. ..... 702/163
4,651,974 A * 3/1987 Frommherz ..... 254/294
6,126,143 A * 10/2000 Fukunaga et al. ..... 254/344
6,497,035 B1 * 12/2002 Ratliff ..... 29/596

FOREIGN PATENT DOCUMENTS

| | | |
|---|---|---|
| DE | 1 928 683 | 12/1969 |
| DE | 2 003 837 | 8/1970 |
| DE | 199 25 364 C2 | 12/2000 |

* cited by examiner

*Primary Examiner*—Kathy Matecki
*Assistant Examiner*—Evan Langdon
(74) *Attorney, Agent, or Firm*—Henry M. Feiereisen

(57) ABSTRACT

Apparatus for slip-free determination of a cable motion in longitudinal cable direction for a hoist, in particular a pneumatically operated cable balancing hoist, which includes a housing, and a cable drum having an outer surface area formed with a groove for receiving a cable. The cable drum is rotatably supported in the housing and moveable in a longitudinal direction in such a way that a run-off point of the cable is at a same location at any time. A sensor is provided to detect markings of the cable drum, as the markings move relative to the sensor during rotation of the cable drum, for delivering an output signal. The groove defines a helical ridge in parallel relationship to the groove, wherein the markings are provided along the ridge, and wherein the sensor is secured to the housing in confronting relationship to the ridge.

19 Claims, 3 Drawing Sheets

APPARATUS FOR ASCERTAINING A CABLE MOTION FOR A HOIST, IN PARTICULAR A PNEUMATICALLY OPERATED CABLE BALANCING HOIST

CROSS-REFERENCES TO RELATED APPLICATIONS

This application claims the priority of German Patent Application Serial No. 101 27 238.3, filed May 28, 2001, pursuant to 35 U.S.C. 119(a)–(d), the subject matter of which is incorporated herein by reference.

BACKGROUND OF THE INVENTION

The present invention relates, in general, to an apparatus for ascertaining a cable motion for a hoist, in particular a pneumatically operated cable balancing hoist. The present invention also relates to a hoist having incorporated therein an apparatus for ascertaining a cable motion, and to a cable drum for use with a hoist and cooperation with an apparatus for ascertaining a cable motion.

German Pat. Nos. DE 1928683 and DE 2003837 describe each a pneumatic hoist for balancing the weight of a load. The hoist includes a cable drum in which a piston is arranged for movement in longitudinal direction. The cable drum is connected to a spindle in fixed rotative engagement, with the spindle extending in coaxial relationship to the cable drum and turning a nut which is securely fixed to the housing. As the piston is acted upon by gas pressure and displaced, the cable drum is caused to move with the piston and to rotate as the spindle turns in the nut. The cable drum is formed with a drum groove for a cable which is guided downwards from a run-off point to a load-carrying member. The pitch of the drum groove is so selected that the run-off point of the cable is always at the same spot of the housing.

It is also known in conjunction with a slip-free determination of the cable movement to arrange at one end of the cable drum a circular disk which is driven by the cable drum and provided with markings that evenly spaced from one another. As the cable drum rotates, the circular disk is caused to rotate and the markings move past a sensor of a sensor unit which detects the markings. Thus, the sensor unit provides an output signal commensurate with a rotation movement of the cable drum. This approach suffers shortcomings because the apparatus is complex and cumbersome.

It would therefore be desirable and advantageous to provide an improved apparatus for slip-free determination of a cable motion for a hoist, which obviates prior art shortcomings and which is compact and simple in structure while still being reliable in operation.

SUMMARY OF THE INVENTION

According to one aspect of the present invention, an apparatus for ascertaining a cable motion in longitudinal cable direction for a hoist of a type having a housing, and a cable drum which has an outer surface area, formed with a groove for receiving a cable, wherein the cable drum is rotatably supported in the housing and moveable in a longitudinal direction in such a way that a run-off point of the cable is at a same location, includes a sensor for detecting markings of the cable drum to deliver an output signal as the markings move relative to the sensor during rotation of the cable drum, wherein the groove defines a helical ridge in parallel relationship to the groove, wherein the markings are provided along the ridge, and wherein the sensor is secured to the housing in confronting relationship to the ridge.

The present invention resolves prior art problems by exploiting the ridge as substrate or carrier element for the markings so that the apparatus becomes rugged and has a simple construction because it is only required to arrange a sensor on the housing and to provide the markings on the ridge.

Generation of an output signal in a simple way may be realized by providing the markings in the form of single marking elements having defined length and moving conjointly with the cable drum.

According to another feature of the present invention, the markings may be arranged on a ferrite strip which carries the markings in the form of alternating magnetic and nonmagnetic regions of same length and same spaced-apart relationship. In this way, simple markings are provided which can be detected without contact. Suitably, the ferrite strip is supported on a steel band as substrate. A compact construction can be implemented when forming the ridge with a groove for receiving the steel substrate.

According to another feature of the present invention, the sensor may be a Hall sensor to realize a reliable and simple detection of the markings.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
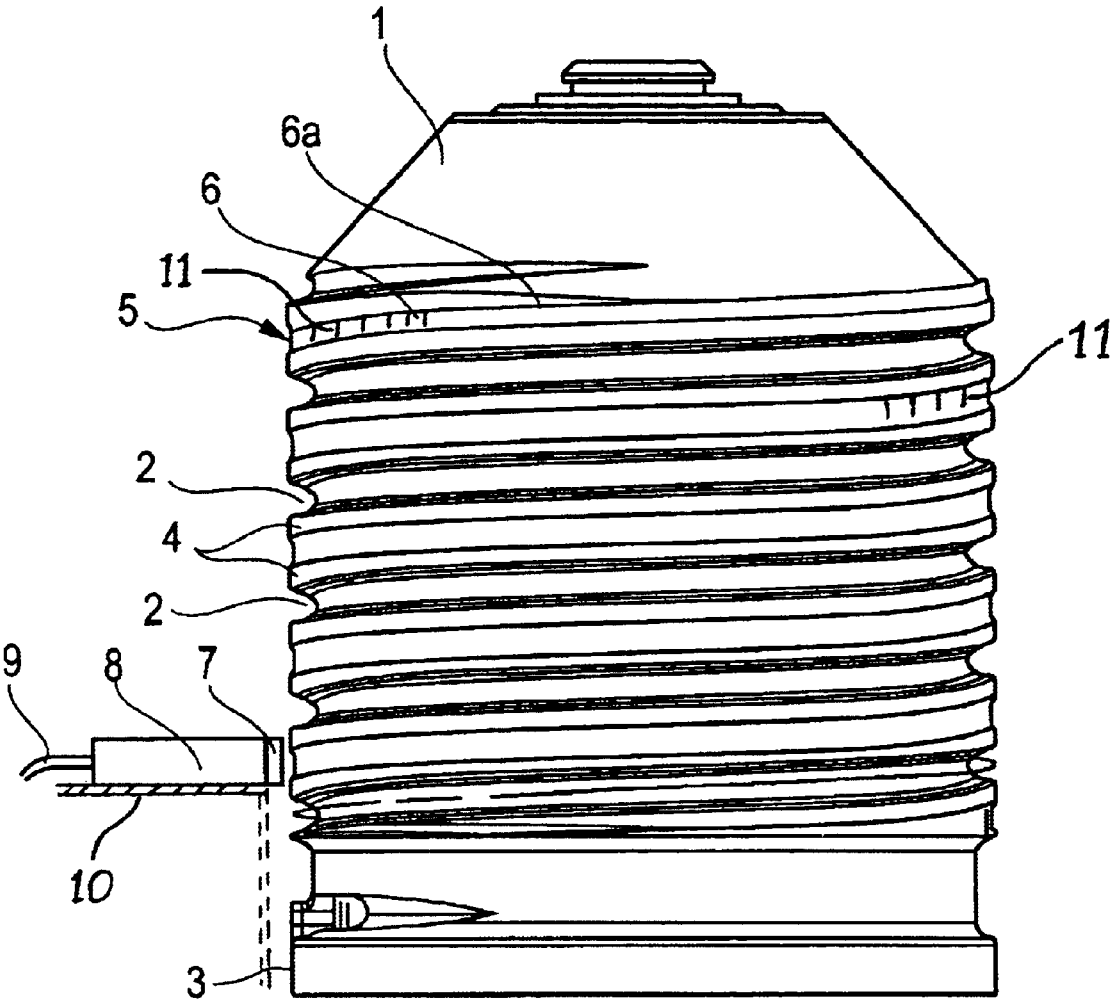
FIG. 1 is a three-dimensional illustration of a cable drum and a sensor unit, forming parts of an apparatus for ascertaining a cable motion in accordance with the present invention.
Figure 2:
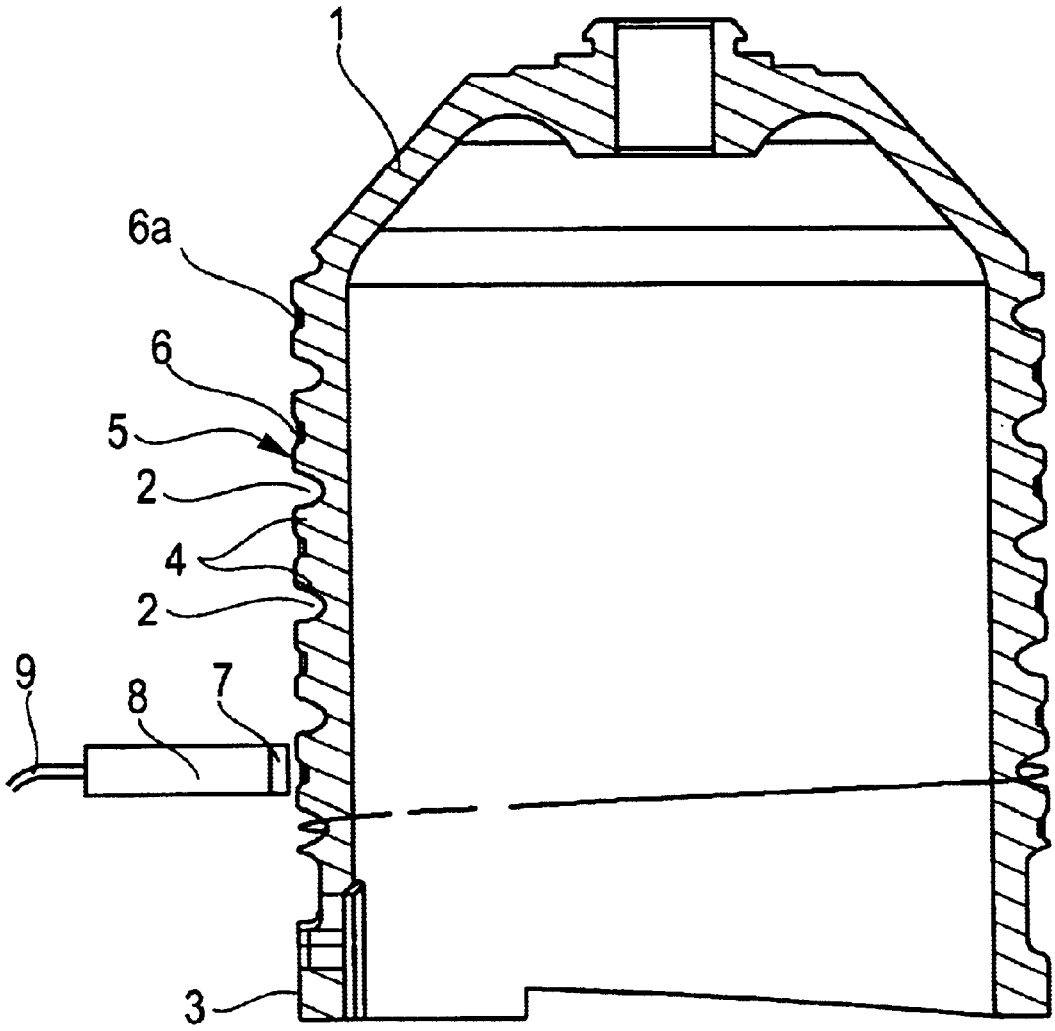
FIG. 2 is a sectional view of the cable drum in conjunction with the sensor unit.
Figure 3:
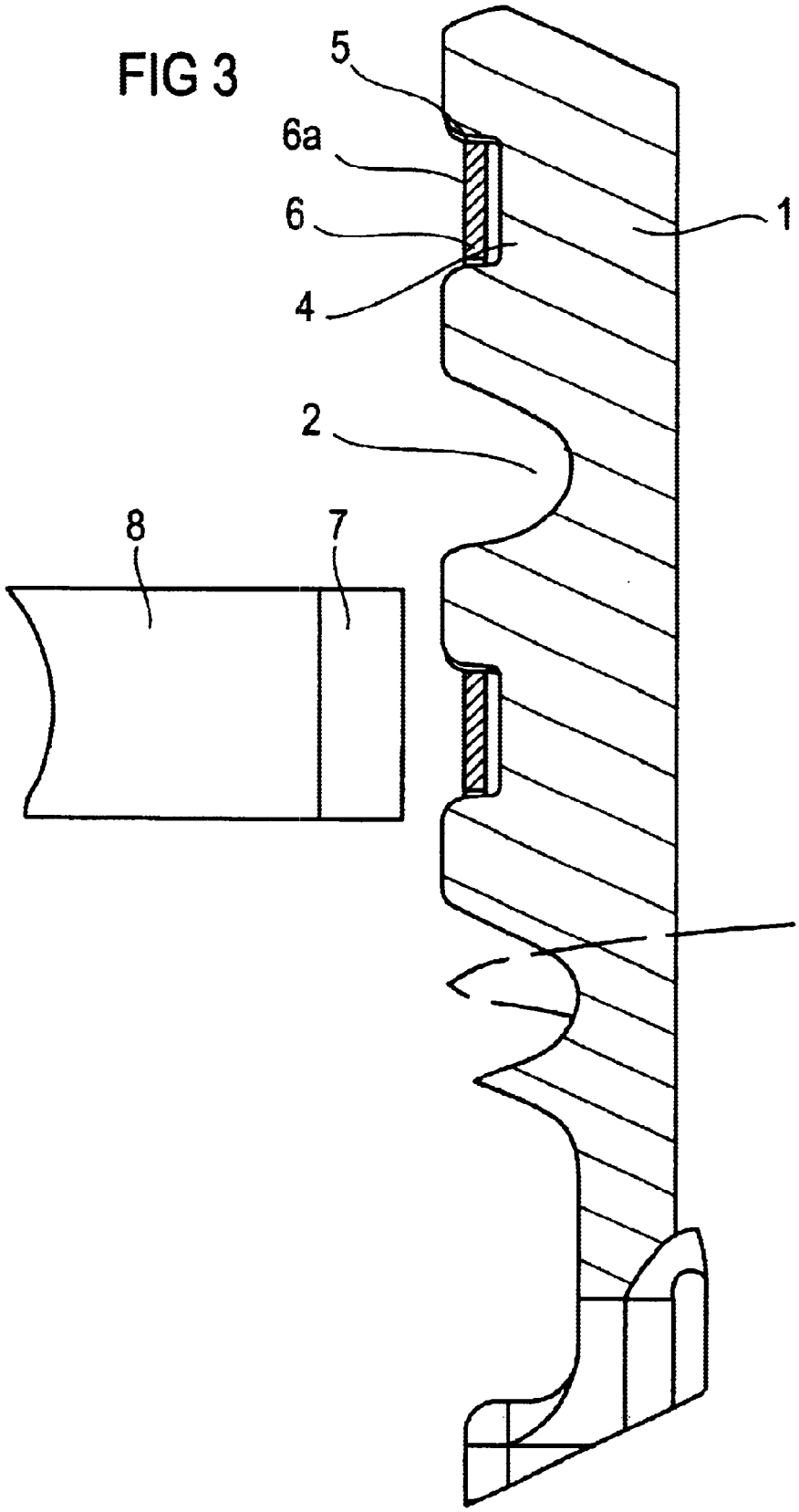
FIG. 3 is a cutaway view, on an enlarged scale, of the cable drum and the sensor unit.

Throughout all the Figures, same or corresponding elements are generally indicated by same reference numerals.

Turning now to the drawing, and in particular to FIG. 1, there is shown a three-dimensional illustration of a cable drum 1 and a sensor unit 8, forming parts of an apparatus for ascertaining a cable motion in accordance with the present invention. The cable drum 1 is supported for movement in a longitudinal direction in a housing of a hoist, e.g. a pneumatically operated cable balancing hoist, which has been omitted from the Figures for the sake of simplicity. A specific construction and manner in which a cable drum is operatively and functionally incorporated into the hoist is fully described for example, in German Pat. Nos. DE 1928683 and DE 2003837. Briefly, the drive of the hoist includes the arrangement of a piston in the cable drum for movement in longitudinal direction. The cable drum is arranged in fixed rotative engagement on a spindle which extends in coaxial relationship to the cable drum and turns a nut which is securely fixed to the housing. As the piston is acted upon by gas pressure and displaced, the cable drum is caused to move with the piston and to rotate as the spindle turns in the nut.

The cable drum 1 has an outer surface 3 area formed with a helical drum groove 2 for a cable (not shown) which is routed downwards to a load-carrying member. The drum groove 2 has a pitch which is so selected that the run-off point of the cable is always at the same spot of the housing.

Extending in parallel relationship to the drum groove 2 is a helical ridge 4 which has formed therein a groove 5 running along the ridge 4 and receiving a steel band 6. The steel band 6 carries on its outwardly directed surface a ferrite layer 6*a* to form together with the steel band 6 a so-called ferrite band. The ferrite layer 6*a* has markings 11 in the form plural single marking elements of defined length. For example, the markings may be realized by an alternating arrangement of magnetized and non-magnetized regions of equal length and width and same spaced-apart relationship, Of course, although this arrangement of magnetized and non-magnetized regions is a presently preferred embodiment, the present invention is not limited thereto, as other configurations or dimensions of the regions are possible as well, without departing from the spirit of the present invention. For example, the dimensions of the regions may vary especially along the ferrite band.

As an alternative, the markings may also be realized by holes, barcodes, elevations or indentations.

Provided in confronting relationship to the ferrite layer 6*a* in opposition of the ridge 4 is a sensor 7 which is part of a sensor unit 8 secured to a housing wall 10 of the housing of the hoist. The sensor 7 may be a Hall sensor and detects passing electric magnetic fields, as the marking pass by, to generate commensurate electric output signals which are transmitted as output signal by the sensor unit 8 via a connecting cable 9 to a control unit (not shown).

It is to be understood by persons skilled in the art that the cable drum described here in connection with a balancing hoist is equally applicable to any other type of hoist which generally follows the concepts outlined here, so long as the cable drum is so moved in longitudinal direction during lifting and lowering that the run-off point of the cable stays at the same position. In this way, the sensor 7 detects the markings on the ferrite layer 6*a,* as the cable drum 1 rotates and the ferrite layer 6*a* passes the sensor 7 in confronting disposition.

While the invention has been illustrated and described as embodied in an apparatus for ascertaining a cable motion for a hoist, in particular a pneumatically operated cable balancing hoist, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

What is claimed is:

1. Apparatus for ascertaining a cable motion in longitudinal cable direction for a hoist, in particular a pneumatically operated cable balancing hoist, having a housing, and a cable drum which has an outer surface area formed with a groove for receiving a cable, wherein the cable drum is rotatably supported in the housing and moveable in a longitudinal direction in such a way that a run-off point of the cable is at a same location, said apparatus comprising a sensor for detecting markings of the cable drum to deliver an output signal as the markings move relative to the sensor during rotation of the cable drum, wherein the groove defines a helical ridge in parallel relationship to the groove, wherein the markings are provided along the ridge, and wherein the sensor is secured to the housing in opposition to the ridge.

2. The apparatus of claim 1, wherein the markings are realized by single marking elements having defined length and moving conjointly with the cable drum.

3. The apparatus of claim 1, and further comprising a ferrite strip received in the ridge and carrying the markings in the form of alternating magnetic and nonmagnetic regions of same length and same spaced-apart relationship.

4. The apparatus of claim 3, and further comprising a steel substrate for support of the ferrite strip.

5. The apparatus of claim 4, wherein the ridge has a groove for receiving the steel substrate.

6. The apparatus of claim 1, wherein the sensor is a Hall sensor.

7. The apparatus of claim 1, wherein the markings are a member selected from the group consisting of holes, barcodes, elevations and indentations.

8. A hoist, comprising:

a housing;

a cable drum rotatably supported in the housing and having an outer surface area formed with a groove for receiving a cable, wherein the groove defines a helical ridge in parallel relationship to the groove;

a marking provided along the ridge; and a sensor, secured to the housing in opposition to the ridge, for detecting the marking of the cable drum as the marking moves relative to the sensor during rotation of the cable drum to ascertain a cable motion in longitudinal cable direction.

9. The hoist of claim 8, wherein the marking includes plural single marking elements having defined length and moving conjointly with the cable drum.

10. The hoist of claim 8, wherein the marking includes a ferrite strip received in the ridge and carrying the marking elements in the form of alternating magnetic and nonmagnetic regions of same length and same spaced-apart relationship.

11. The hoist of claim 10, wherein the marking includes a steel substrate for support of the ferrite strip.

12. The hoist of claim 11, wherein the ridge has a groove for receiving the steel substrate.

13. The hoist of claim 8, wherein the sensor is a Hall sensor.

14. A cable drum for a hoist, comprising:

a body rotatably supported in a housing of a hoist and having an outer surface area formed with a groove for receiving a cable, wherein the groove defines a helical ridge in parallel relationship to the groove;

a marking provided along the ridge for cooperation with a sensor, secured to the housing in opposition to the ridge, for detecting the marking of the cable drum as the marking moves relative to the sensor during rotation of the cable drum to ascertain a cable motion in longitudinal cable direction.

15. The cable drum of claim 14, wherein the marking includes plural single marking elements having defined length and moving conjointly with the cable drum.

16. The cable drum of claim 14, wherein the marking includes a ferrite strip received in the ridge and carrying the marking elements in the form of alternating magnetic and nonmagnetic regions of same length and same spaced-apart relationship.

17. The cable drum of claim 16, wherein the marking includes a steel substrate for support of the ferrite strip.

18. The cable drum of claim 17, wherein the ridge has a groove for receiving the steel substrate.

19. The cable drum of claim 14, wherein the sensor is a Hall sensor.

* * * * *